US008262386B2

(12) United States Patent
Bouvier et al.

(10) Patent No.: US 8,262,386 B2
(45) Date of Patent: Sep. 11, 2012

(54) GAS BURNING HAND TOOL

(75) Inventors: Daniel Bouvier, Paris (FR); Yves Guillou, Chelles (FR); Christophe Le Drappier, Pantin (FR); Laurent Tacchella, Villemomble (FR)

(73) Assignee: Guilbert Express, Fontenay Sous Bois (FR)

( * ) Notice: Subject to any disclaimer, the term of this patent is extended or adjusted under 35 U.S.C. 154(b) by 1035 days.

(21) Appl. No.: 12/198,321

(22) Filed: Aug. 26, 2008

(65) Prior Publication Data

US 2009/0075221 A1 Mar. 19, 2009

(30) Foreign Application Priority Data

Sep. 13, 2007 (FR) ..... 07 06419

(51) Int. Cl.
*F23Q 7/12* (2006.01)
*F23D 14/12* (2006.01)
*F23D 14/64* (2006.01)

(52) U.S. Cl. ..... 431/254; 431/255; 431/328; 431/354

(58) Field of Classification Search ..... 431/254, 431/255, 328, 354
See application file for complete search history.

(56) References Cited

U.S. PATENT DOCUMENTS 2,118,228 A * 5/1938 Ravenna ..... 239/214.13
2,880,793 A 4/1959 Golden
6,010,329 A * 1/2000 Zagoroff ..... 431/158

FOREIGN PATENT DOCUMENTS

GB 132869 9/1919

* cited by examiner

*Primary Examiner* — Kenneth Rinehart
*Assistant Examiner* — William Corboy
(74) *Attorney, Agent, or Firm* — Oblon, Spivak, McClelland, Maier & Neustadt, L.L.P.

(57) ABSTRACT

Burner (5) for a gas burning hand tool (1), of the type comprising an elongated burner body (21), associated at opposite ends of the body with a gas injection zone (17) and a gas combustion zone (19). The gas injection zone (17) comprises at least one outlet orifice (35) terminating flush on the outside of the periphery (25) of the burner body (21), this periphery (25) promoting the circulation of the gas outside the burner body (21) to the combustion zone (19). Gas burning hand tool equipped with a burner of this type.

24 Claims, 7 Drawing Sheets

Figure 1:
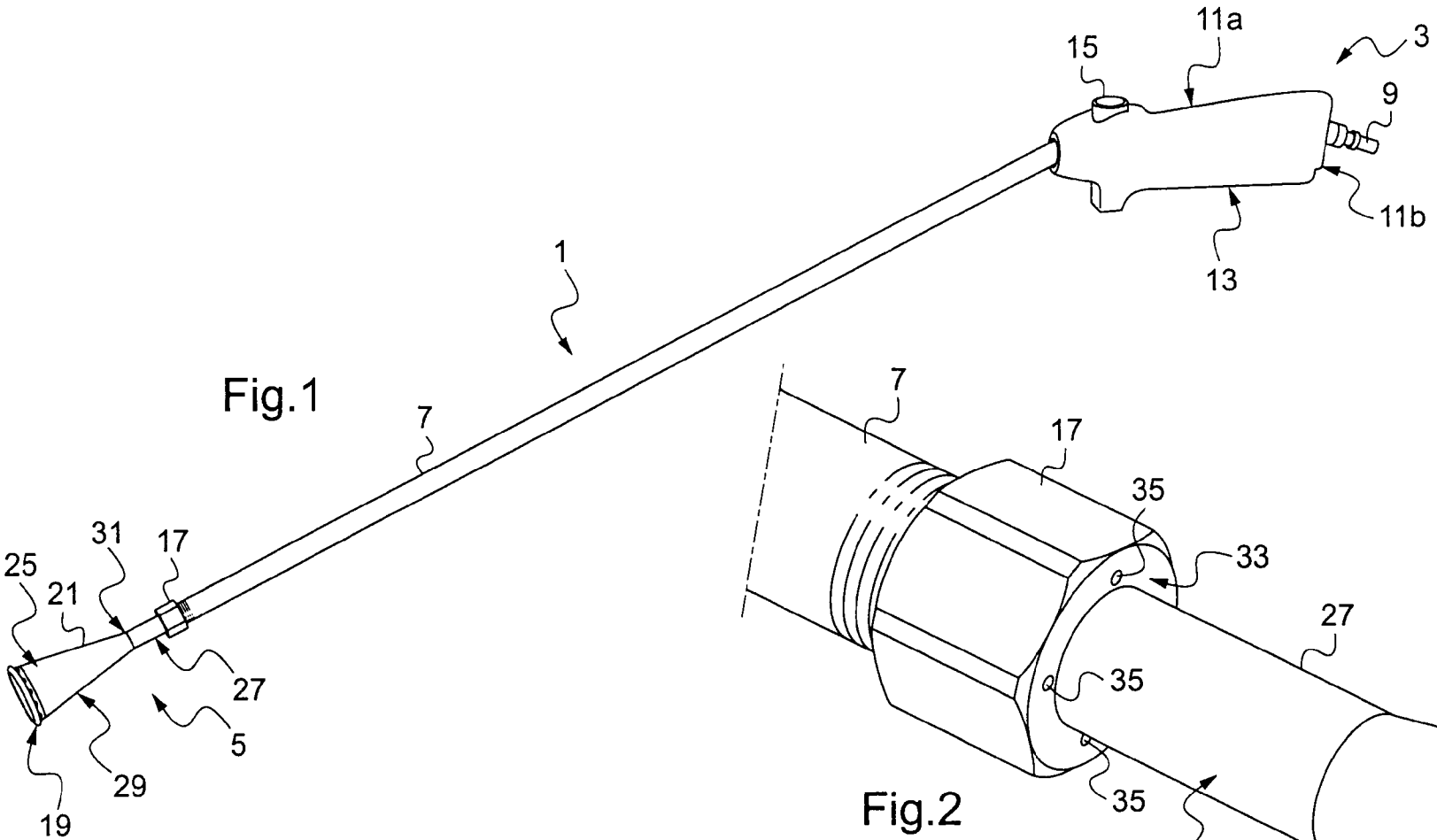

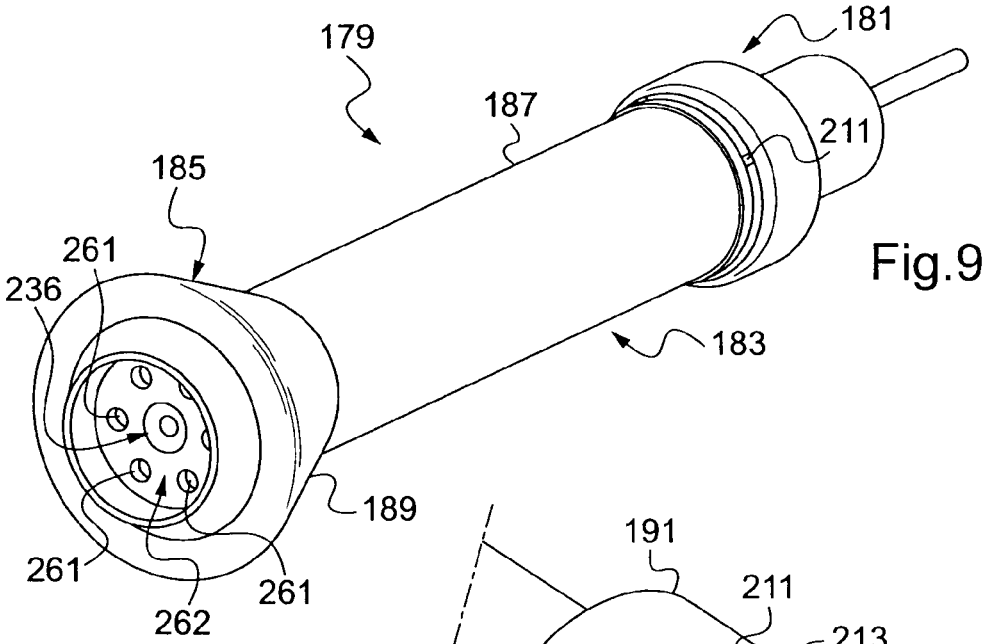
Fig.9
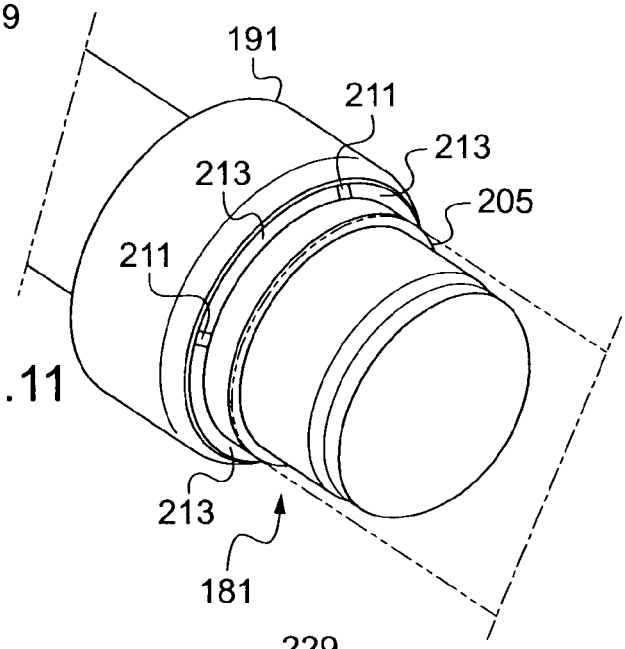
Fig.11
Fig.12
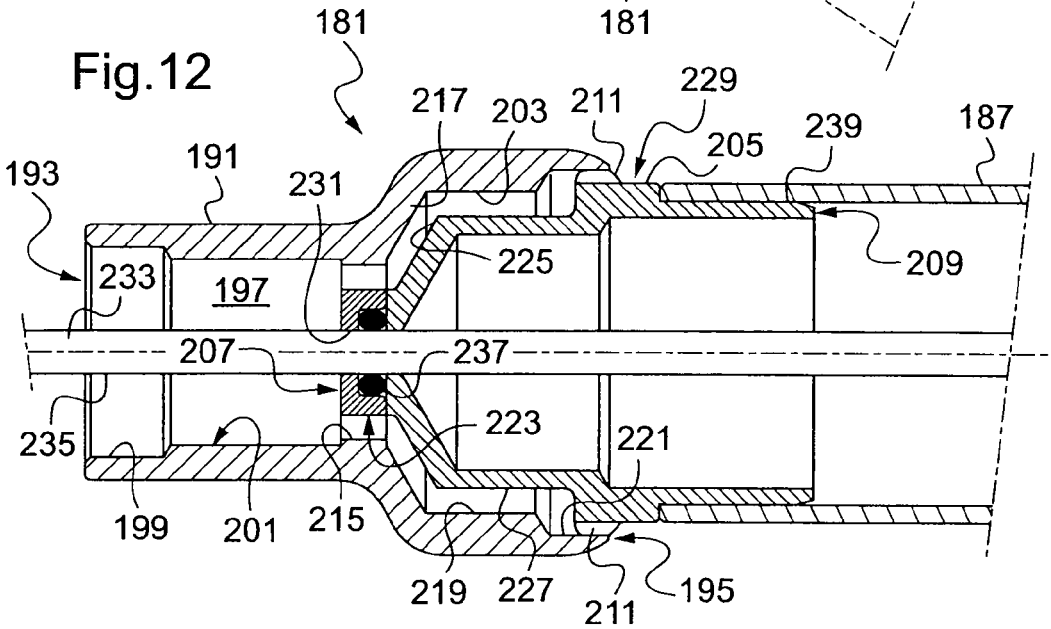

GAS BURNING HAND TOOL

The present invention relates to the field of improved gas burning hand tools.

In tools of this type the combustion of a gas is used to produce flames, which constitute the active element of the tool.

Numerous categories of tools of this type exist. In blowpipes, for example, the flames are mainly used for cutting or welding. In torches, the flames generally serve to heat all types of surfaces to be worked.

For example, torches are commonly used to heat and thereby bond the strips that serve to mark out pedestrian pathways on a road.

These torches are also useful since the procedure involves removing films of plastics material by heating them.

Numerous other fields are thus involved. By way of example, films of this type are used to cover pleasure boats when they are taken out of the water, for example during winter. These films can also be used to cover and protect civil engineering structures.

Gas burning hand tools generally comprise a gas burner as the active or useful part of the tool.

The burner generally comprises an elongated burner body associated at opposite ends of the body with a gas injection zone and a gas combustion zone.

Certain applications of the gas burning tools require high outputs, for example of the order of 100 kilowatts, in particular, but not only, when torch type tools are used.

In order to increase the useful output of a tool, the dimensions of the body of its burner are normally increased, so as to circulate therein a larger amount of air and gas mixture to be burnt.

As a result the tools are heavy and cumbersome, which makes them tiring to use, in particular when they have to be held at arm's length. Such tools are also difficult to manipulate, especially when working in cramped conditions or attempting to reach sites a fairly long way from the user, which means that the user then has to work with outstretched arms.

Tools with a burner body of titanium have been proposed in order to obviate the disadvantage of the weight. These tools are still cumbersome however and are also very expensive.

The object of the invention proposed by the applicants is accordingly to improve this state of affairs.

The invention thus relates to a burner for a gas burning hand tool, of the type comprising an elongated burner body associated at opposite ends of the said body with a gas injection zone and a gas combustion zone, wherein the gas injection zone comprises at least one outlet orifice terminating flush with the outside of the periphery of the burner body, this periphery effectively promoting the circulation of the gas outside the burner body towards the combustion zone.

The invention also relates to a gas burning hand tool equipped with a burner of this type.

The gas circulates from the injection zone to the combustion zone along the outer peripheral surface of the burner body. On this trajectory the gas mixes with the ambient air. The volume of air that can be mixed with the gas is not restricted. As a result the spatial dimensions of this burner body are greatly reduced, particularly since most of the mixture of gas and air mixture no longer circulates in the interior of the burner body. A larger gas flow can be obtained, while maintaining a reasonable size for the burner. The applicants have accordingly designed tools in which the diameter of the burner body is roughly 30 mm, whereas a conventional design would have required, for a comparable output, a diameter of at least 80 mm.

Figure 2:
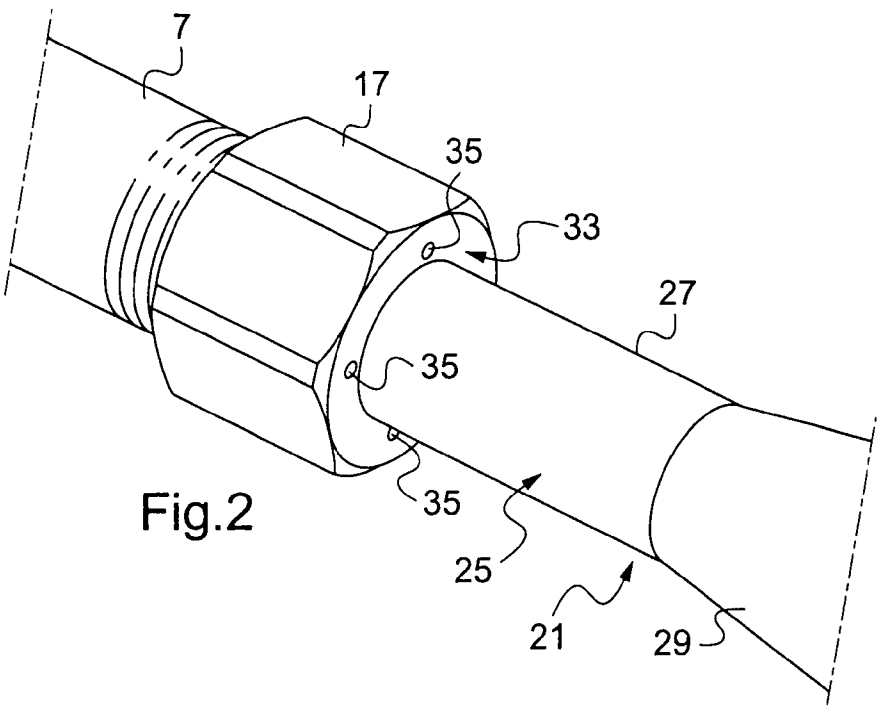
Figure 3:
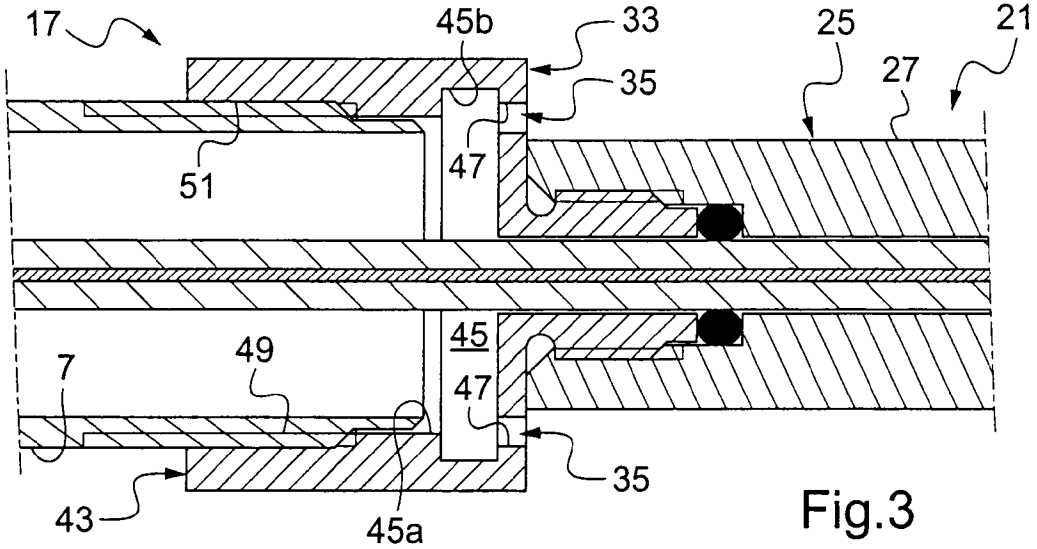
Figure 4:
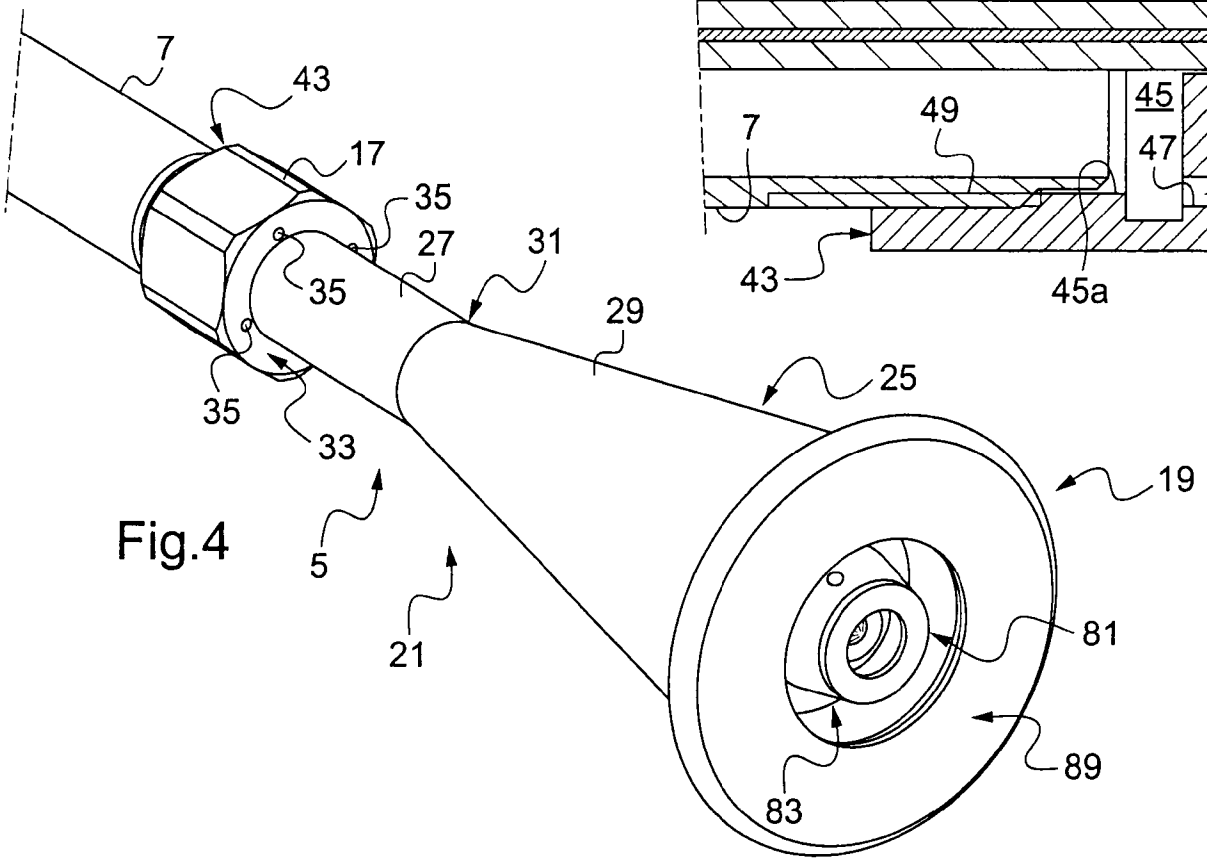
Figure 5:
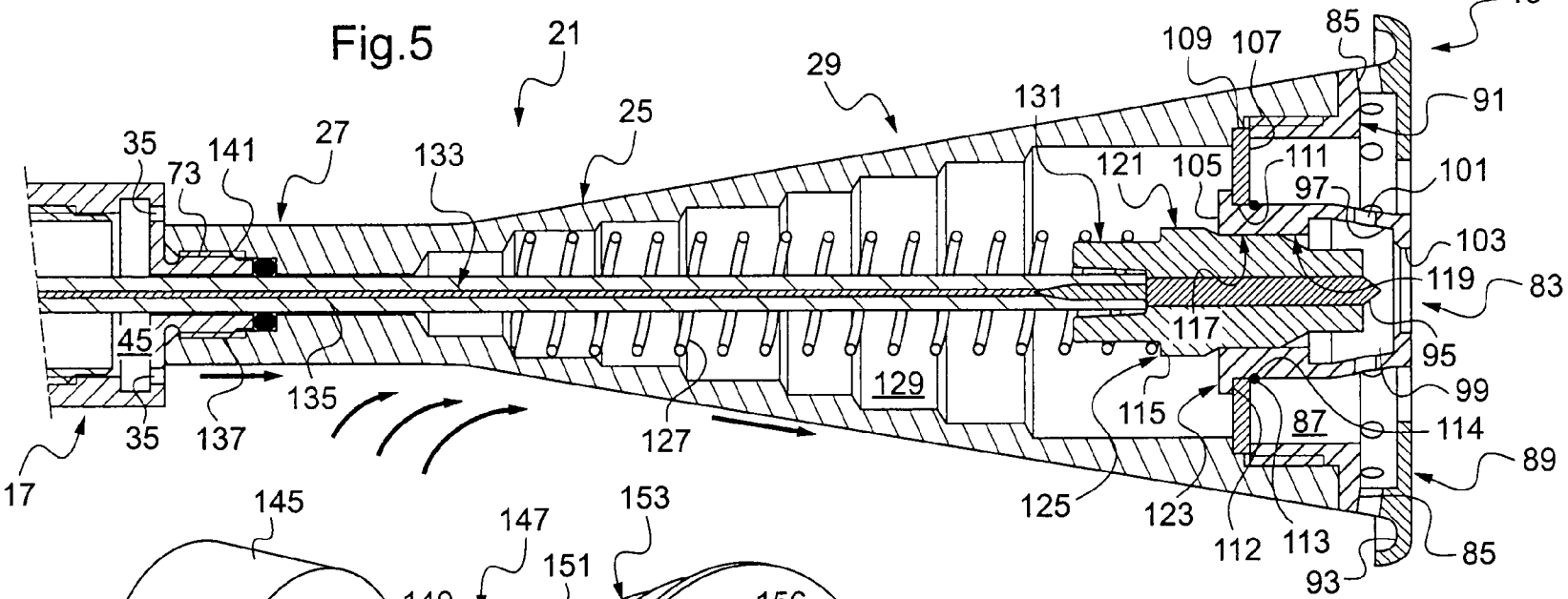
Figure 6:
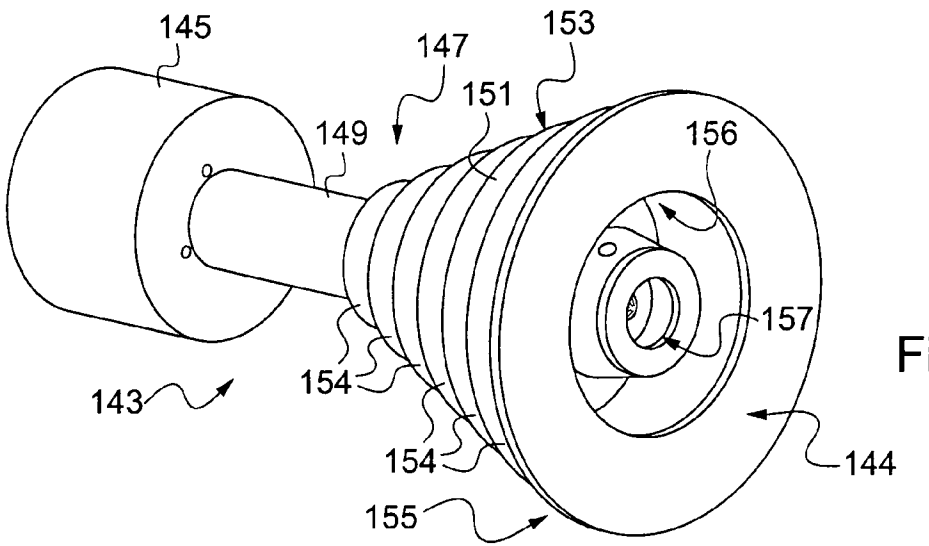
Figures 7, 8:
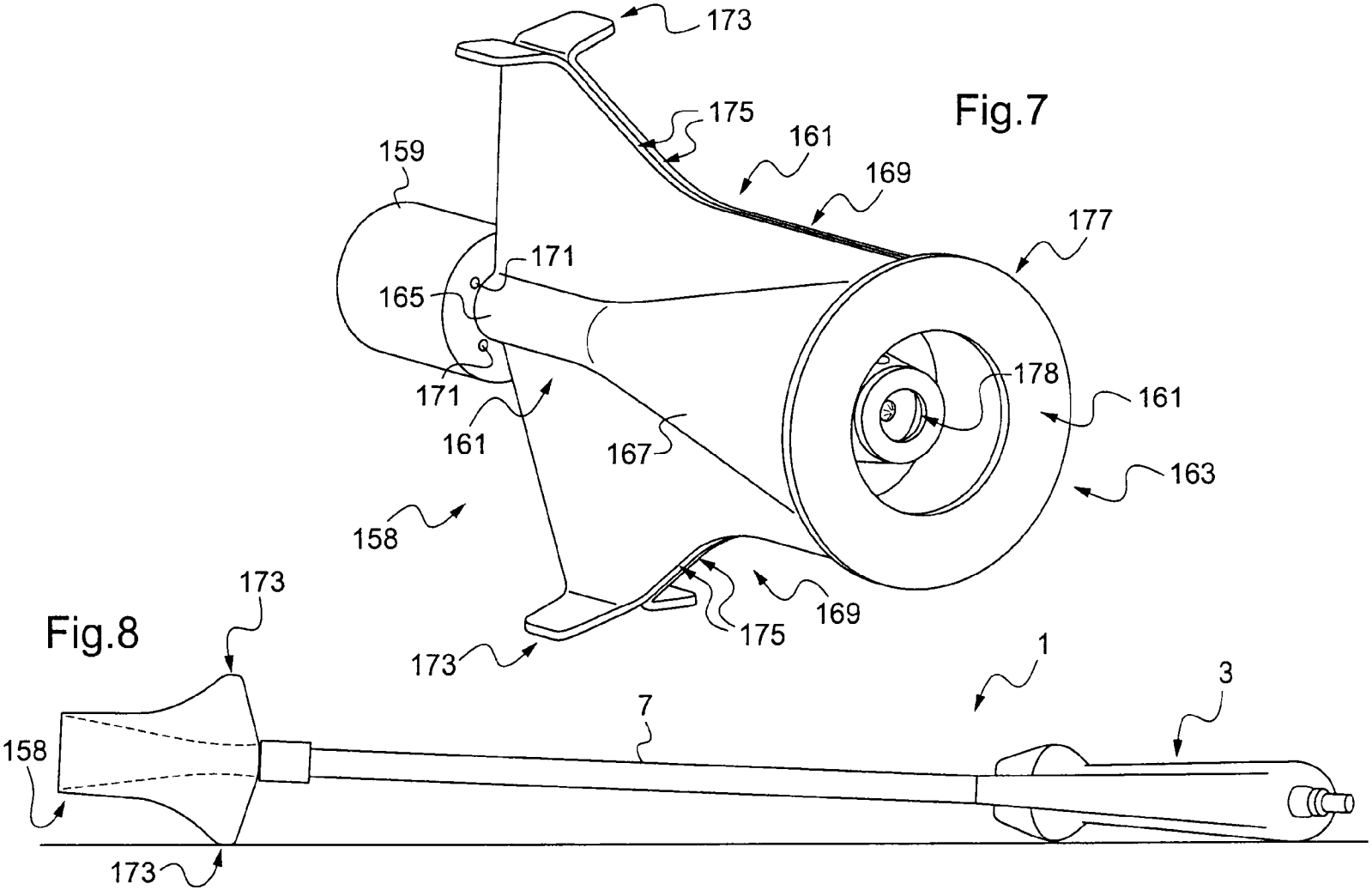
Figure 10:
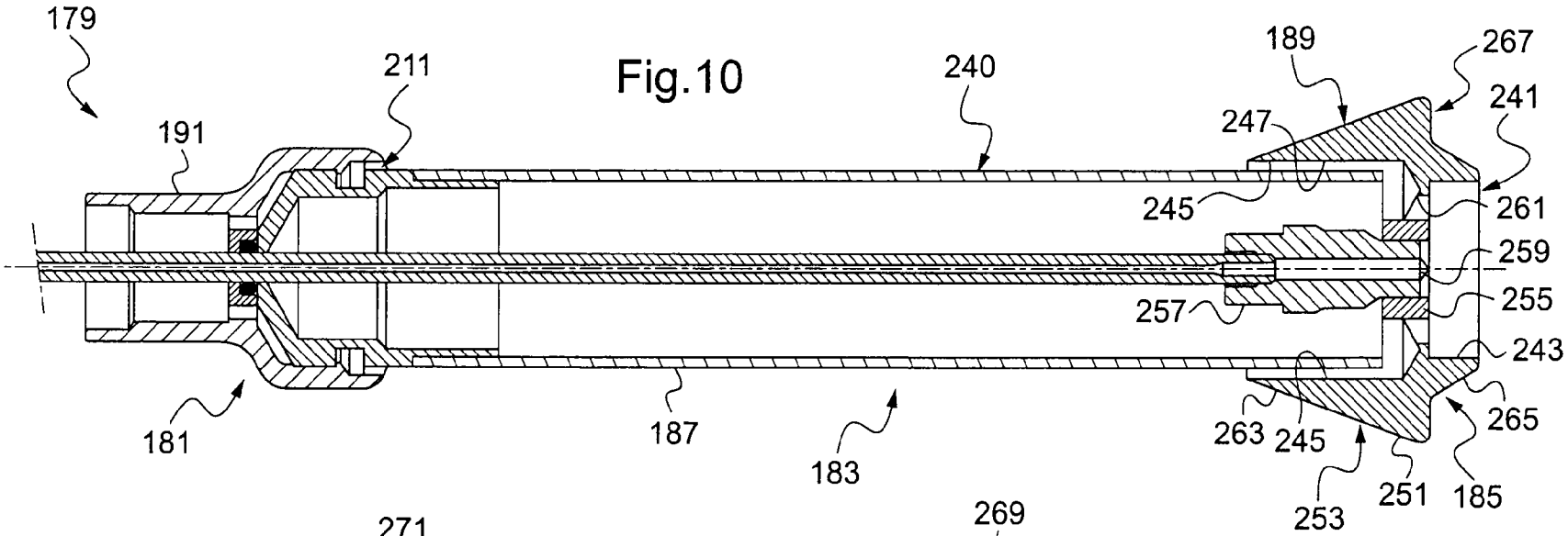
Figure 14:
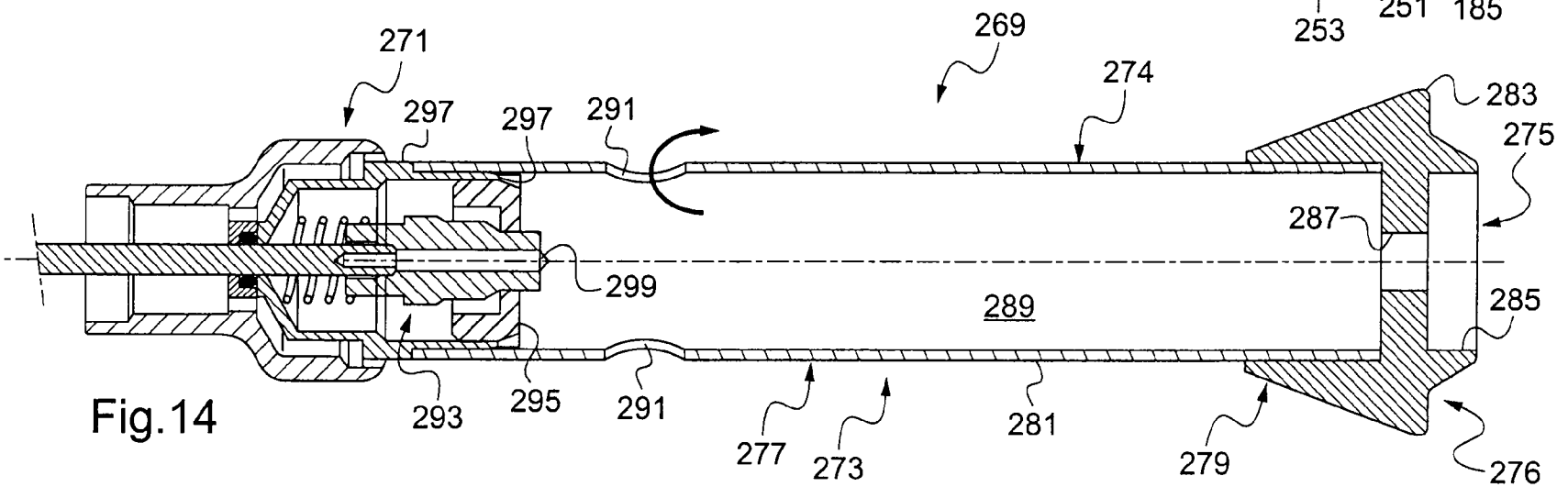
Figure 13:
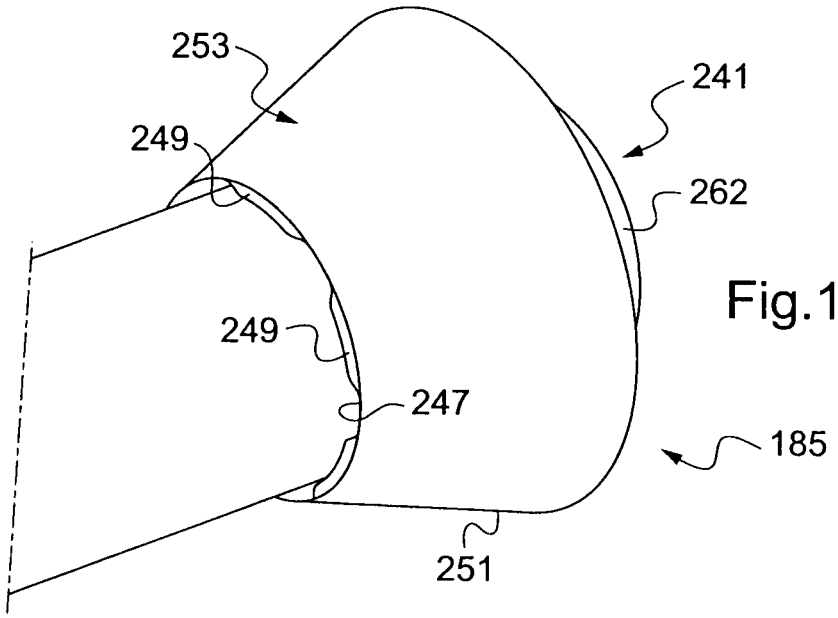
Figure 15:
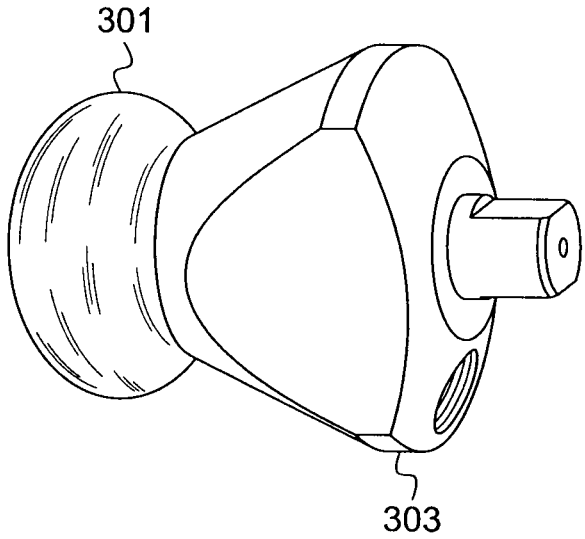
Figure 16:
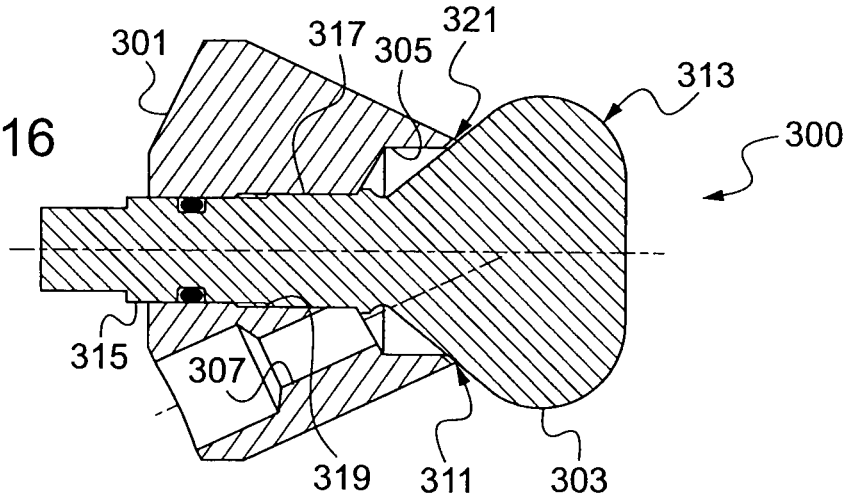

Other characteristic features and advantages of the invention will appear on reading the following detailed description, given with reference to the accompanying drawings and in which:

FIG. 1 is a perspective view of a lance torch equipped with a gas burner according to a first embodiment of the invention, FIG. 2 is a perspective view of a first part of the burner of FIG. 1, FIG. 3 is a longitudinal sectional view of the burner part of FIG. 2, FIG. 4 is a perspective view of a second part of the burner of FIG. 1, FIG. 5 is a longitudinal sectional view of the burner part of FIG. 4, FIG. 6 is a perspective view of a gas burner according to a second embodiment of the invention, FIG. 7 is a perspective view of a gas burner according to a third embodiment of the invention, FIG. 8 is a perspective view of a lance torch equipped with the gas burner of FIG. 7, FIG. 9 is a perspective view of a gas burner according to a fourth embodiment of the invention, FIG. 10 is a longitudinal sectional view of the burner of FIG. 9, FIG. 11 is a perspective view of a first part of the burner of FIG. 9, FIG. 12 is a longitudinal sectional view of the burner part of FIG. 11, FIG. 13 is a perspective view of a second part of the burner of FIG. 9, FIG. 14 is a longitudinal sectional view of a burner according to a fifth embodiment of the invention, FIG. 15 is a perspective view of a variant of implementation of a gas injector for a burner according to the invention, and FIG. 16 is a longitudinal sectional view of the injector of FIG. 15.

The accompanying drawings will serve not only to supplement the invention, but also contribute to its description where necessary.

FIG. 1 shows a lance torch 1 as an example of a gas burning hand tool implementing the invention.

The lance torch 1 basically comprises a gripping handle 3 and a gas burner 5, connected to one another by a gas circulation tube 7.

The handle 3 can be connected to a gas source, the pressure of which is reduced to the desired utilisation pressure, by means of a gas connector 9 arranged so as to receive the end of a flexible pipe (not shown) connected to the gas source (not shown).

The handle 3 comprises in particular a gripping sleeve 11. This sleeve comprises an upper part 11*a*, designed to accommodate the palm of the user's hand, and a lower part 11*b*, from which projects downwardly a control lever 13 enabling a gas supply device (not shown) situated in the handle 3 to be actuated. A gas flow regulating device could also be provided instead of the gas inlet device, or to supplement the latter. The actuating lever 13 is designed to be actuated by the user's fingers.

The terms "lower" and "upper" refer here to a rest position of the lance 1, as normally maintained by the user and shown in FIG. 1. The use of these terms does not imply any restriction as regards the operating positions of this lance 1.

The handle 3 is realised here in the form of two separate lateral parts joined to one another, which facilitates the assembly of the handle 3 and the attachment of the flow regulating device.

If desired the handle 3 can also include a gas pressure indicator 15, arranged here on the upper part 11*a* of the sleeve 11.

The handle 3 may also have a shield (not shown) designed to prevent any unintentional contact with the control lever 13.

The gas circulation tube 7 is arranged so as to be able to withstand high gas pressures, generally between 0 and 7 bar.

The tube 7 shown here is fairly long. The length of the tube 7 can depend on the envisaged applications of the tool. For example, the applicants currently envisage marketing tubes 300 mm, 500 mm and 700 mm in length, so as to cover a large range of uses. Different lengths can be envisaged, possibly specific to a particular application.

The fact that the tube 7 is long enables the user to cover large working areas with only a slight extension of the arm or hand, and also to access working areas further away.

The burner 5 comprises a gas injector 17 arranged here in the vicinity of one of its ends, a main combustion zone 19 arranged at the end of the elongated burner 5 distant from the injector 17, and an elongated burner body 21 connecting the combustion zone 19 to the injector 17. The combustion zone 19 forms the "useful" or "active" part of the lance 1: the flame resulting from the combustion of the gas is concentrated in this combustion zone 19.

The circulation of the gas from the injector 17 to the combustion zone 19 is actively promoted by the burner body 21, outside the latter. The mixing of the gas with the ambient air takes place along the flow on the burner body 21.

The injector 17 is in fluid communication with the circulation tube 7.

The gas to be lit can reach the lance 1 through the connector 9 and circulate in the interior of the tube 7 so as to reach the injector 17. From here, the gas passes to the combustion zone 19, at the same time mixing with the air. The gas flow rate can be controlled by the position of the lever 13 with respect to the handle 3.

The injector 17 is arranged so that the gas reaches the combustion zone 19 by circulating over the peripheral surface 25 of the burner body 21. In other words, the burner body 21 is arranged so that a portion of its peripheral surface 25 extends from the injector 17, or in the vicinity of the latter, to the combustion zone 19. While circulating over this peripheral surface 25 the gas mixes with the ambient air so that a mixture of air and gas ready to be ignited reaches this combustion zone 19.

The burner body 21 has a first section 27 close to the injector 17, and a second section 29 close to the combustion zone 19, and connected to the first section 27.

In this embodiment the first section 27 generally has the shape of a right cylinder, and the second section 29 generally has the shape of a truncated cone, the truncated cone being arranged coaxially to the cylinder.

The dimensions of the right cylinder and the dimensions of the truncated cone are such that these parts join onto one another without any abrupt change in diameter, so as to obtain a continuous surface flow of gas from the injector 17 to the combustion zone 19.

During its flow over the first section 27 and then over the second section 29, the gas draws in air from the surroundings and mixes with the latter. A mixture of combustion gas and air is thus available at the combustion zone 19.

The burner body 21 has a zone of inflection 31, situated in this case at the end of the first section 27 and of the second section 29. This zone of inflection 31 is in the form of a transitional zone between a generally cylindrical shape and a generally truncated conical shape. Other realisations are however conceivable.

The zone of inflection 31 enables a shock wave to be created in the gas flow. This shock wave increases the perturbations in the flow, thereby improving the mixing of the gas with the ambient air.

FIG. 2 shows on an enlarged scale the junction of the injector 17 with the circulation tube 7 and with the burner body 21.

The injector 17 has a downstream end face 33, close to the first section 27 of the burner body 21, provided with a plurality of gas outlet orifices 35 arranged in the immediate vicinity of the peripheral surface 25 of the body 21. Each of the gas outlet orifices is flush with the peripheral surface 25. Here, this flush alignment is tangential, but in other realisations it could be inclined, for example so as to obtain, at least partially, a flow along a helical path.

The injector 17 has the general shape of a right cylinder and a substantially hexagonal external profile. The outlet orifices 35 are distributed substantially uniformly on a circle centred on the longitudinal axis of the injector 17, and of chosen radius slightly greater than the external diameter of the cylinder forming the first section 27 of the burner body 21. The injector 17 and the first section 27 of the burner body 21 are disposed substantially coaxially with respect to one another. This configuration provides for a substantially homogeneous injection over the circumference of the burner body 21.

FIG. 3 shows the injector 17 in detail.

The injector 17 has an upstream end face 43 remote from the downstream end face 33, intended to receive the end of the circulation tube 7 remote from the handle 3.

The injector 17 has a circulation channel 45 for the gas, open on the upstream end face 43 and in fluid communication with the gas outlet orifices 35. Here, the circulation channel 45 of the injector 17 is connected to each of the outlet orifices 35, in each case by an injection passage 47. In other words, each of the injection passages 47 is connected to the circulation channel 45 of the injector 17, and terminates at the downstream end face 33 of the injector 17 in an outlet orifice 35. The outlet orifices 35 are arranged flush with the peripheral surface, outside the latter.

Here, the injection passages 47 are in the form of straight bores of circular cross-section, and are arranged substantially parallel to the axis of the first section 27 of the burner body 21. Thus, the combustion gas can be injected substantially parallel to the peripheral surface 25, so as to surround the latter along a flow direction substantially parallel to the extension direction of the peripheral surface 25. The cross-section of each of the orifices 35 can be modified so as to adapt the gas flow on the surface 25. The distance from each of these orifices 35 to the peripheral surface 25 can also be a function of the envisaged gas flow.

In the assembled state, the circulation tube 7 terminates in the circulation channel 45 of the injector 17, so as to ensure a circulation of gas from the circulation tube 7 to the outlet orifices 35.

The injector 17 and the tube 7 are arranged substantially coaxially with respect to one another.

The tube 7 and the injector 17 are joined by screwing them together: the tube 7 has, in the vicinity of its corresponding end, an external thread 49 designed to engage in a tapping 51 provided in the vicinity of the upstream end face 43 of the injector 17. Here, the tapping 51 is arranged in the circulation channel 45 of the injector 17, and the thread 49 is arranged on the circumference of the tube 7.

The injector 17 is made in the form of a single piece (monobloc), in which are machined the channel 45 and the injection passages 47. The injector thus has an excellent resistance to high gas pressures.

The circulation channel 45 comprises a first section 45*a*, terminating on the upstream end face 43, and a second section 45*b*, of larger diameter, in which the injection channels 47 terminate.

In FIG. 4 the burner body 5 is provided, in the vicinity of the end of the body 21 remote from the injector 17, with a flame capture or control device 81, designed to "fix" the flame at the said end of the burner body 21, and with a flame lighting device 83 to initiate the combustion of gas.

In FIG. 5 a plurality of gas branch channels 85 connect the peripheral surface 25 of the burner body 21 to a hollow space 87 provided in the burner body 21. The hollow space 87 is open on a useful end face 89, or flame capture zone, of the burner body 21, remote from the injector 17, in the present case in a central zone of this useful end face 89. Each of these branch channels 85 is open on the peripheral surface 25 and terminates in the hollow space 87.

The hollow space 87 comprises an annular groove 91 arranged in the burner body 21, and in which terminates each of the branch channels 85.

In operation, a small part of the mixture of air and gas circulating over the periphery of the burner body 21 utilises the branch channels and emerges in the annular groove 91. This annular groove 91 is the site of pilot flames, that is to say flames that participate in the capture of the flame on the useful end face 89. The pilot flames support the combustion of most of the mixture, which reaches the useful end face 89 by circulating outside the second section 29 and along the peripheral surface 25.

The mixture of air and gas that flows into the annular groove 91 moves at a very low flow velocity, compared to the flow velocity of the gas leaving the orifices 35 of the injector or the end of the burner body 21. In addition, the pilot flames are protected in the interior of the hollow space 87. This assists in the efficient formation of the pilot flames.

The peripheral surface 25 of the burner body 21 has in the vicinity of the branch channels 85, here in the vicinity of the useful end 89, an annular curved deviation section 93 in the shape of a spoon or bowl. By virtue of this shape the deviation section 93 of the peripheral surface 25 removes a small amount of the gas/mixture circulating over the surface 25 and directs this amount towards the branch channels 85. The greater part of the gas/mixture bypasses this deviation section 93 so as to reach the useful end face 89, where it is lit, in part due to the pilot flames. Different shapes can also be envisaged for the deviation cross-section 93, which form an obstacle to the flow of the gas, for example in the shape of an annular shoulder.

The flame capture device 81 comprises at least the branch channels 85 and the annular groove 91.

The flame lighting device 83 comprises a lighting electrode 95, the active end of which is located in a flame lighting enclosure 97 arranged in the hollow space 87 in the vicinity of the branch channels 85.

The lighting enclosure 97 is in the form of a space bounded by a protection wall 99 and in fluid communication with the hollow space 87, so that a small amount of the mixture of gas and air present in the hollow space 87 can reach the lighting enclosure 97. The protection wall 99 has a plurality of secondary channels 101 connecting the hollow space 87 to the enclosure 97, here arranged transversely to the electrode 95. The protection wall 99 has in addition a flame opening 103, opposite the active end of the electrode 95, and open in the vicinity of the active end face 89.

In the hollow space 87, at the outlet of the branch channels 85, the mixture of air and gas has a very low flow velocity. In addition, a very small amount of mixture reaches the hollow space 87 via this route. Finally, the hollow space 87 is protected from the outside and in particular from most of the flow of the gas/air mixture. As a result conditions are particularly favourable for the lighting of the mixture. The protected configuration of the site where the flame is lit prevents any danger of extinction of the spark or flame by the main flow of the gas, which takes place for the most part on the outside of the burner. In other words, the lighting device is protected from the main gas flow, which can thus take place at a high flow rate without any risk of extinguishing the flame. These favourable conditions allow the mixture to be lit by sparks, and thus with a low energy input. An easy and simple lighting of the tool, even at high gas flow rates, is thus achieved.

This overcomes a disadvantage frequently encountered in conventional gas burning tools, namely that these are particularly sensitive and difficult to light, especially when high gas flow rates are involved.

The hollow space 87 constitutes a lighting and control zone for the flame.

The protection wall 99 is realised in the form of a protection hood 105, installed in the interior space 87 by means of a fixing ring 107. The fixing ring 107 is located in a fixing groove 109, provided in the interior space 87. The ring 107 has a central orifice 111, in which the hood 105 is held by means of a suitable arrangement, a bearing against an abutment shoulder 112 and an elastic collar 113, disposed in an annular groove 114. The fixing ring 107 and the hood 105 are here realised in the form of separate parts, but could also be made in one piece, for example in order to reduce the number of parts of the tool and thereby facilitate the assembly.

In the present case the burner body is formed of at least two parts: a terminal part comprising the branch passages 85, the curved part 93, the hollow space 91, screwed onto a principal part comprising essentially the first section of the peripheral surface and a truncated conical part of the second section.

A mounting socket 115 holds the electrode 95 in the hood 105. The mounting socket 115 is in the shape of a body of revolution, having a cylindrical surface 117, mounted in a cylindrical orifice 119 of the hood 105.

The socket 115 has in addition a first shoulder 121 designed to rest against an internal end face 123 of the hood 105. The socket 115 also acts as a thermal insulation. To this end, the socket is made of an electrically insulating or dielectric material, for example a ceramic material.

The socket 115 also has a second shoulder 125, against which bears a compression spring 127. The opposite end of this compression spring 127 bears against the floor of a longitudinal recess 129 provided in the interior of the burner body 21, in this case in the second section 29. The spring is moreover guided by a cylindrical surface 131 provided in the vicinity of the end of the socket 115 remote from the active end of the electrode. This central recess 119 has in the present case a staggered or stepped structure, generally following the truncated conical external profile of this second section 29.

The electrode 95 is supplied with electric current by a conductor wire 133, connected to a current source (not shown), arranged here in the handle 3. The conductor wire 133 is surrounded by a protective sheath 135. This conductor wire 33 runs to the interior of the circulation tube 7, passes through the injector 17, then reaches a longitudinal passage 137 traversing the interior of the first section 27 of the burner body 21 (FIG. 5), along its longitudinal axis, so as to reach the central recess 129 of the second section 29 of the burner body 21.

The burner body 21 and the injector 17 are screwed onto one another: the downstream end face 33 of the injector 17 has a projection 73 provided with a thread 137 that cooperates with a tapping 141 machined centrally in the interior of the first section 27 of the burner body 21.

In FIG. 6 the gas burner 143 illustrates a second embodiment of the invention.

The burner 143 comprises an injector 145, similar to the injector 17, and a burner body 147. This burner body 147 comprises a first section 149, generally in the form of a right cylinder, and a second section 151, generally of truncated conical shape. This second section 151 has externally a staggered shape, that is to say the external peripheral surface 153 of the burner body 147 describes, along the second section 151, successive steps 154 in the form of coaxial cylindrical portions, the diameters of which increase with the distance from the first section 149.

The successive steps 154 enable the perturbation of the gas flow to be controlled in such a way that the flame is correctly "caught" on an active end face 144 of the burner 143, in the vicinity of a combustion zone 155. This stepped configuration means that the total burner length 143 and the maximum cone width of the second section 151 are reduced compared to the previously described burner 5. In other words, the burner 143 occupies less space thanks to the stepped configuration of the second section 151.

The burner 143 also comprises a flame capture device 156 and a flame lighting device 157 similar to those described previously.

In FIG. 7, the gas burner 158 illustrates a third embodiment of the invention.

The burner 158 comprises a gas injector 159, similar to the injector 17 previously described, and a burner body 161 connecting the injector 159 to a combustion zone, or active zone 163.

The burner body 161 comprises a first section 165, close to the injector 159, and a second section 167, connected to the first section 165 and close to the combustion zone 163, this combustion zone 163 being disposed in the vicinity of an active end face 164 of the burner 161 remote from the injector 159.

The first section 165 has the general shape of a right cylinder, while the second section 167 has the general shape of a truncated cone. The burner body 161 has a generally rotationally symmetric and elongated shape.

The burner 158 in addition comprises two protective flanges or wings 169 projecting radially from the burner body 161.

The flanges 169 are arranged oppositely with respect to the axis of the burner body 161, thereby protecting half of a plurality of gas injection orifices 171, in the direction of external air currents.

Each of the flanges 169 has, in a zone remote from the burner body 161, a support foot 173, realised here in the form of a generally flat part and arranged transversely to the flange 169.

A foot 173 enables the burner 157 to be placed on the ground or on any other flat surface when the torch 1 is not in use, as is shown in FIG. 8.

Here, each of the flanges 169 is realised in the form of two flat plates 175 placed side by side, each having a general delta shape, one corner of this delta being bent substantially at a right angle so as to form a foot part 173.

The burner body 161 is realised in the form of two parts placed side by side, each of these parts comprising two semi-flanges 175, a semi-cylinder forming the first section 165 and a semi-cone forming the second section 167. These parts can be made by stamping, followed by welding or crimping. Such a configuration of the burner allows at least some of the constituent elements of a flame capture device 177 and of a flame lighting device 178 to be accommodated before the two parts are joined together. If necessary strips or beading can be provided in the interior of these parts so as to facilitate the positioning of the said elements.

The flame capture device 177 and the lighting device 178 are here similar to those previously described. These devices are attached at the end of the burner body 161.

In FIGS. 9 and 10 a gas burner 179 illustrates a fourth embodiment of the invention.

The burner 179 comprises a gas injector 181 disposed at one of the ends of a burner body 183, which has at its other end a combustion zone 185.

The burner body 183 comprises a first section 187, close to the injector 181, and a second section 189, close to the combustion zone 185.

The first section 187 has the general shape of a right cylinder, while the second section 189 has the general shape of a truncated cone.

FIGS. 11 and 12 illustrate in detail the injector 181.

The injector 181 comprises a connecting sleeve 191 with an upstream end face 193 arranged so as to receive the end of the circulation tube 7 remote from the handle 3, a downstream end face 195 close to the burner body 183, and a gas circulation channel 197 connecting the upstream end face 193 and the downstream end face 195.

The channel 197 of the sleeve 191 comprises an inlet section 199 terminating at the upstream end face 193, and arranged so as to receive the end of the tube 7.

Here, the inlet section 199 has a tapping 201 arranged so as to co-operate with a thread (not shown) provided at the end of this tube 7.

The channel 197 of the sleeve 191 comprises in addition an outlet section 203 terminating at the downstream end face 197, and in fluid communication with the inlet section 199.

The injector 181 comprises furthermore an internal core 205 having an upstream end face 207 and a downstream end face 209.

The core 205 is designed so as to be able to be accommodated, at least partly, in the outlet section 203 of the sleeve 191. In particular, the core 205 has a general external shape matching the general shape of the outlet section 203, but of dimensions that in section are similar and similarly aligned, so that the outlet section 203 is not blocked by the core 205. In other words, the circumference of the core 205 follows the circumference of the outlet section of the channel 197.

In the vicinity of the downstream end face 195 of the sleeve 191, the core 205 has partition elements 213 projecting from the perimeter of the core 205 and in contact with the perimeter of the outlet section 203.

The injector thus has a plurality of gas outlet orifices 211 in the form of apertures arranged in the vicinity of the downstream end face 195 of the sleeve 191, between the interior of the sleeve 191 and the exterior of the core 205, these apertures being separated from one another by the partition elements 213. In other words, the gas outlet orifices 213 are present here in the form of annular portions disposed in the immediate proximity of the peripheral surface of the burner body. The partition elements 213 are shaped as annular portions.

The gas outlet orifices 203 are flush with the periphery of the first section 187.

More specifically, the outlet section 203 of the channel 197 has a first cylindrical section 215 close to the inlet section 199, which extends towards the downstream end face 195 and transforms into a second section 217, in the form of a divergent truncated cone, which itself extends into a third cylindrical section 219, which terminates in a fourth cylindrical section 221 of larger diameter than the third section 219.

The perimeter of the core 205 has a first cylindrical section 223, which extends towards the downstream end face 195, and transforms into a second divergent truncated cone section 225, which itself extends into a cylindrical third section 227 of larger diameter, which latter terminates in a fourth section 229, also cylindrical and of larger diameter. The fourth section 229 carries the partition elements 211, which project radially from this section.

In the assembled state the perimeter of the core 205 is slightly displaced in the axial direction with respect to the perimeter of the outlet section 203, towards the downstream end face 195. In other words, the first section 223 of the core 205 starts slightly further on from the upstream front face 193 of the sleeve 191, and extends slightly further than the similar section of the outlet section 223, and so on for the other sections.

The core 205 is realised here in the form of a single rotationally symmetric and hollow part. A passage hole 231 terminating at the upstream end face 193 of the core 205 is arranged so as to allow the passage of a conducting wire 233 surrounded by a protective sheath 235 for supplying electric current to a flame lighting device 236 (visible in FIG. 9), similar to that previously described. An annular sealing joint 237 is placed between the passage hole 231 and the protective sheath 235.

The core 205 is arranged in the vicinity of its downstream end face 195, in a cylindrical bearing 239 intended to receive the end of the first section 187 of the burner body 183, realised here in the form of a tubular part.

The burner body 183 has a peripheral surface 240, formed in part by the external surface of the tubular part forming the first section 187. In the assembled state the said tubular part is flush with the section 229 of the external surface of the core 205. The result is that the gas outlet orifices 211 are flush with the peripheral surface 240 of the burner body 183.

FIGS. 10 and 13 show in detail the combustion zone 185.

The burner body 183 has an active end face 241, remote from the injector 181. The combustion zone 185 comprises a hollow space 243 provided in the burner body 183 and open on the active end face 241. A plurality of branch channels 245 connect the peripheral surface 240 of the burner body 183 to the hollow space 243, so that at least a small portion of the gas propelled by the injector 181 and circulating over the peripheral surface 240 reaches the hollow space 243. Most of the mixture of air and gas circulates outside the burner body 183, and reaches the active end face 241. Each of the branch channels 245 extends first of all parallel to the longitudinal axis of the first cylindrical section 187, and then deviates so as to reach the hollow space 243.

The branch channels 245 are thus arranged at the same level as the peripheral surface 240, in the extension of the latter, so that a small quantity of the air and gas mixture reaches there directly.

The branch channels 245 are created by providing free spaces, in the vicinity of the end of the first section 187, between the peripheral surface 240 and an enveloping surface 247 surrounding this end of the first section 187. Here, the enveloping surface 247 has a cylindrical shape, of diameter substantially greater than the diameter of the first section 187.

In this configuration the proportion of air and gas mixture removed from the main flow on the peripheral surface 240 depends largely on the height of the branch channels 245, which height can thus be adapted depending on the flame lighting.

In the vicinity of the end of the first section 187 partition elements 249 are arranged in the free space remaining between the peripheral surface 240 and the enveloping surface 247, in such a way as to delimit the branch channels 245. The partition elements 249 project radially from the enveloping surface 247 and come into contact with the peripheral surface 240.

Here, a terminal part 251 is attached in the vicinity of the end of the first section 187. In other words, the burner body 183 comprises here at least two separate parts, which are attached to one another.

The terminal part 251 has a peripheral surface 253 that forms the peripheral surface 240 of the second section 189 of the burner body 183. This peripheral surface 253 has a generally truncated conical shape.

The terminal part 251 comprises an annular retaining portion 255 arranged on the central axis of this terminal part 251. The retaining portion 255 is open at the hollow space 243, and is formed to as to receive a retaining socket 257. A flame lighting electrode 259 is disposed axially in the retaining socket 257. This electrode 259 is connected to the conducting wire 233.

A plurality of junction orifices 261 is provided in the terminal part 241, so as to connect the branch channels 245 to the hollow space 243. Each of the junction orifices 261 extends substantially parallel to the longitudinal axis of the burner body 183. In operation, the ends of these junction orifices situated in the hollow space 243 are the site of pilot flames. These ends are arranged around the flame lighting device 236, which is itself situated in a central zone of the hollow space. Here, these ends of the junction orifices 261 are distributed in a substantially uniform manner on a circle centred on the lighting device 236. The junction orifices 261 form at least in part a flame capture device 262.

The pilot flames are generated at a favourable point where the flow velocity of the gas leaving the orifices 261 is low: this improves the conditions for lighting the gas. These pilot flames light the main flow of the mixture of air and gas circulating on the outside, the flow velocity of which, being greater, would not otherwise allow the flame to be lit on the active end face 241.

The peripheral surface 253 of the terminal part 251 comprises a first truncated conical section 263, close to the first section 187 of the burner body 183, opening in the direction of the active end face 241. The peripheral surface 253 of the terminal part 251 terminates in a second truncated conical section 265, which closes in the direction of the active end face 241. This second section 265 of the terminal part 251 terminates practically in the hollow space 243. An annular junction section 267 arranged transversely to the longitudinal axis of the burner body 183 joins the first 263 and second 265 sections of the terminal part 251.

In FIG. 14 the burner 269 illustrates a fifth embodiment of the invention.

The burner 269 comprises a gas injector 271 similar to the injector 181 previously described, and a burner body 273 connecting the injector 271 to an active end face 275 situated in a combustion zone 276.

The burner body 273 comprises a peripheral surface 274 having a first section 277 of generally cylindrical shape, and a second section 279 of generally truncated conical shape, opening in the direction of the active end face 275.

The burner body comprises here a tubular main part 281, to which is attached a terminal part 283 at its end remote from the injector 271. The first section 277 of the peripheral surface 274 is formed by a peripheral surface part of the main part 281, while the second section 279 is formed by a part of the peripheral surface of the terminal part 283. The burner body comprises a hollow space 285 open on the active end face 275. The hollow space 285 has a cylindrical shape and is arranged along the longitudinal axis of the burner body 269.

The attachment of the terminal part 283 to the main part 281 is realised here without providing any clearance or play other than the clearance necessary for the installation. The gas circulating on the peripheral surface 270 can reach the hollow space 285 only by flowing over the periphery of the second section 279.

A junction channel 287 provided in the terminal part 283 connects the hollow space 285 to the interior space 289 of the main part 281, which is here tubular.

A plurality of outflow orifices 291 connect the first section 270 to the internal space 289 of the main part 281. The outflow orifices 291 are distributed over the circumference of the first portion 270, substantially closer to the injector 271 than to the active end face 275.

A flame lighting device 293, similar to the previous embodiment, is disposed in a retaining cap 295 blocking a downstream end face 297 of the core 297 of the injector 271. The active end of the flame lighting electrode 299 is disposed in the internal space 289 of the main part.

The outflow orifices 291 are arranged in the vicinity of the lighting device 293.

An amount of non-combusted mixture of combustion gas and air circulates in the internal space 289.

The lighting system is protected from the external environment.

The capture of the flames on the active end face 275 is effected by the perturbations or turbulences that are created at the end of the second truncated conical section 279.

In FIGS. 15 and 16 a gas injector 300 is shown as a variant of embodiments of the previously described injectors.

The injector 300 consists principally of a female part 301 and a male part 303 inserted in the female part 301.

The female part 301 comprises a receiving space 305, in which terminates a gas feed pipe 307. The receiving space 305 comprises, at its opening on the outside, a bevelled edge 309 arranged opposite a substantially truncated conical portion 311 of an external surface 313 of the male part 303.

The male part 303 has a cylindrical securement section 315 provided with a thread 317 capable of co-operating with a tapping 319 provided in the female part 301.

The angle of the bevelled edge 309 is substantially equal to the vertex angle of the truncated conical portion 311, with the result that an annular gas outlet orifice 321 is thus obtained.

The burners described above enable high gas flow rates to be employed, corresponding to large useful working outputs, without the disadvantage of occupying a large amount of space. This advantage is in large part associated with the circulation of the combustion gas supported by the outer periphery of these burners. When the circulation of the gas takes place in the interior of a burner body, as is the case in conventional burners, the increase in the gas flow rate and, consequently, also in the amount of air to be mixed, leads to an increase in the internal section of the burner body. In the present case, even in the presence of large gas flow rates, the gas mixes satisfactorily with the ambient air, with the result that the mixture can easily be lit. Since the circulation and the mixing of the gas takes place on the outside of the burner, it is possible to obtain tools that are less cumbersome.

The outer surface or, more generally, the length of the gas flow path outside the burner, can be increased or reduced depending on the desired characteristics for the air and gas mixture, and possibly the flame capture.

The aforedescribed burners provide a particularly efficient flame lighting and control, particularly compared to the conventional burners. This advantage results in part from the location of the lighting and control devices in the interior of the burner body, in a zone where the gas flow is turbulent, and at the same time is protected from the main flow, which tends to extinguish or blow out the flames.

In fact, the velocity of the gas leaving the injector can be extremely high, although this velocity is considerably reduced, and even extremely low, when the gas reaches the protected region. This is due in particular to the flow perturbations in this region.

This provision of the lighting and control of the gas in the interior of the burner body is permitted by the external circulation of the gas: because most of the mixture of air and gas reaches the active end of the tool via the outside of the latter, a sufficient space remains free in the interior of the burner.

The invention is not restricted to the burners of the previously described embodiments.

The described burners have rotationally symmetric peripheries. However, surfaces of all shapes, for example planar, are suitable for the implementation of the invention. An important characteristic feature is that the injection of the gas takes place in the vicinity, or on a level with, the peripheral surface, as a result of which an adequate surface flow of gas with a high flow rate can be obtained.

The aforedescribed injectors have gas outlet orifices of circular or partially annular cross-section, or even a single annular orifice. Other configurations can also be envisaged, in particular the provision of a single outlet orifice. The orifices can be formed by different techniques, for example by milling, broaching or also drilling.

Second peripheral surface sections of the truncated conical burner body have been described. This shape allows the internal accommodation of the flame lighting and control devices and at the same time enables an active surface to be obtained that is adapted to the desired use of the tool. However, different geometries can be envisaged, depending for example on the use or shape of the desired flame, or also on the gas flow rate.

Each time that the periphery of the burner body undergoes a change in cross-section from a cylindrical shape to a truncated conical shape, a zone of inflection is created, which improves the mixing between the combustion gas and the ambient air by generating a shock wave.

In the aforedescribed burners, most of the mixture of air and gas flows as far as the combustion zone exclusively over the outside of the tool. Under extremely specific conditions it could however be envisaged that part of this flow takes place in an internal portion of the tool, particularly if this does not interfere with the overall space occupied by the tool or with the relevant flow rate.

As described, the burners have a slow extinction, meaning that a release of the gas control lever results in a complete extinction of the flames, staggered by a few seconds (for example five seconds). This enables the tool to be relit by simply operating the lever, without having to actuate the flame lighting device. This means that the tool is not so sensitive to premature or untimely release of the lever. However, if a rapid extinction of the flame is desired, for example for safety reasons, a stop device could be provided to immediately stop the circulation of gas in the interior of the tool, in conjunction with the release of the control lever.

The torch according to the invention is not restricted to its use in the lance torch 1 described hereinbefore only by way of example, but can be applied to all types of gas burning hand tools.

The invention claimed is:

1. Burner for a gas burning hand tool, comprising:

an elongated burner body, associated at opposite ends of the burner body with a gas injection zone and a gas combustion zone;

at least one branch passage arranged so as to guide a secondary gas circulation from outside a periphery of the burner body to an internal zone of the burner body, in the proximity of a flame control device; and a plurality of gas flow orifices, distributed in a manner corresponding to an opening of the internal zone on a flame capture zone, wherein the gas injection zone comprises at least one outlet orifice terminating flush with an outside of the periphery of the burner body, and the periphery supports circulation of the gas on the outside of the burner body towards the combustion zone, and wherein the flame control device comprises at least one gas flow orifice in fluid communication with the branch passage, said flow orifice being arranged in the proximity of the flame capture zone.

2. Burner according to claim 1, wherein said periphery comprises an at least partially cylindrical first section close to the injection zone.

3. Burner according to one of claims 1 and 2, wherein said periphery comprises an at least partially truncated conical second section close to the combustion zone.

4. Burner according to claim 3, wherein the second section has a stepped structure.

5. Burner according to claim 1, wherein the gas injection zone has the plurality of outlet orifices, each of the outlet orifices terminating flush on the outside of the periphery of the burner body.

6. Burner according to claim 1, wherein the outlet orifice terminates in a gas injection channel, and said channel extends parallel to the external periphery of the burner body at least in the vicinity of the said outlet orifice.

7. Burner according to claim 1, wherein the injection zone has a plurality of outlet orifices distributed around the peripheral surface.

8. Burner according to claim 1, wherein the injection zone comprises at least one at least partly annular outlet orifice surrounding at least partly the periphery of the burner body.

9. Burner according to claim 1, wherein the gas combustion zone has a flame capture zone situated in the vicinity of an end of the burner.

10. Burner according to claim 9, wherein the periphery of the burner body promotes a main gas circulation on the outside of the burner body as far as the flame capture zone.

11. Burner according to claim 9, wherein the combustion zone further includes the flame control device disposed in the internal zone of the burner body, open at the flame capture zone.

12. Burner according to one of claims 9 to 11, wherein the flame capture zone comprises an end face of the burner body.

13. Burner according to claim 1, further comprising:

a flame lighting device disposed in the internal zone of the burner body.

14. Burner according to claim 13, wherein the flame lighting device comprises a protected site in the internal zone in fluid communication with the internal zone.

15. Burner according to one of claims 13 and 14, wherein the internal zone accommodating the flame lighting device is open on the flame capture zone.

16. Burner according to claim 15, wherein the at least one branch passage for guiding the secondary circulation of gas from the periphery of the burner body to the internal zone of the burner body is in the vicinity of the flame lighting device.

17. Burner according to claim 11, wherein the periphery of the burner body has in the vicinity of the branch passage a deviation portion that removes a part of the peripheral gas flow and guides this part of the flow towards the branch passage.

18. Burner according to claim 17, wherein the deviation portion has an annular shape.

19. Burner according to claim 14, wherein the flame lighting device is remote from the flame capture zone, and a circulation channel for combustion gas connects the flame capture zone in the vicinity of the flame lighting device.

20. Burner according to claim 1, wherein the periphery of the burner body has a zone of inflection, between the injection zone and the combustion zone.

21. Burner according to claim 20, wherein the branch passage extends a first section of the burner body, and is open in the vicinity of the zone of inflection.

22. Burner according to claim 1, having at least one protective flange projecting outside the periphery of the burner body, and extending from the injection zone to the vicinity of the combustion zone.

23. Gas burning hand tool comprising the burner according to claim 1.

24. Hand tool according to claim 23, further comprising:

a gripping handle carrying a gas control lever, and a gas transporting tube connecting the gripping handle to the burner.

* * * * *